US009221262B2

(12) United States Patent
Davis

(10) Patent No.: US 9,221,262 B2
(45) Date of Patent: Dec. 29, 2015

(54) CARRIAGE INTERACTION COMPENSATION

(71) Applicant: HEWLETT-PACKARD DEVELOPMENT COMPANY, L.P., Houston, TX (US)

(72) Inventor: Robert D. Davis, Brush Prairie, WA (US)

(73) Assignee: HEWLETT-PACKARD DEVELOPMENT COMPANY, LP., Houston, TX (US)

( * ) Notice: Subject to any disclaimer, the term of this patent is extended or adjusted under 35 U.S.C. 154(b) by 0 days.

(21) Appl. No.: 13/852,006

(22) Filed: Mar. 28, 2013

(65) Prior Publication Data

US 2014/0292842 A1 Oct. 2, 2014

(51) Int. Cl.

| | |
|---|---|
| ***B41J 2/175*** | (2006.01) |
| ***B41J 2/165*** | (2006.01) |
| ***B41J 19/20*** | (2006.01) |
| ***B41J 23/02*** | (2006.01) |

(52) U.S. Cl.

CPC ..... *B41J 2/16508* (2013.01); *B41J 19/202* (2013.01); *B41J 23/025* (2013.01); *B41J 2002/16576* (2013.01)

(58) Field of Classification Search

USPC ..... 347/19, 37, 5, 9

See application file for complete search history.

(56) References Cited

U.S. PATENT DOCUMENTS

| | | | | |
|---|---|---|---|---|
| 4,259,626 | A | 3/1981 | Nomura et al. | |
| 7,131,779 | B1 | 11/2006 | Lin | |
| 7,810,901 | B2 * | 10/2010 | Akiyama | 347/37 |
| 8,123,322 | B1 * | 2/2012 | Paul et al. | 347/19 |
| 8,217,604 | B2 | 7/2012 | Tsumoto | |
| 2012/0092402 | A1 | 4/2012 | Iwai | |

OTHER PUBLICATIONS

Deshpande et al., "Development of an Inkjet Carriage Motion Controller for Dynamic Print Mode Control",2nd IFAC Conference on Mechatronic Systems, California, Dec. 2002.

* cited by examiner

*Primary Examiner* — Lam Nguyen

(74) *Attorney, Agent, or Firm* — Mahamedi Paradice LLP

(57) ABSTRACT

Operation of a carriage is controlled to actuate a mechanism. The carriage is controlled according to a feed forward term and a feedback term, to compensate interaction of the carriage with the mechanism. Thus, the carriage is to engage the mechanism at a reduced velocity for quiet operation, and fully and reliably actuate the mechanism without stalling the carriage.

11 Claims, 6 Drawing Sheets

CARRIAGE INTERACTION COMPENSATION

BACKGROUND

A printer may include a carriage that moves back and forth for printing onto paper. Carriage movement may be based on a carriage motor. Additional aspects of the printer may be powered by additional motors, and the printer may include mechanisms that generate noise during interactions.

BRIEF DESCRIPTION OF THE DRAWINGS/FIGURES

DETAILED DESCRIPTION

A carriage, of an apparatus such as a printer, may be movable to print onto a page using a marking device (e.g., pen) carried by the carriage. Movement of the carriage also may be utilized for other purposes, such as interacting with other mechanisms. In an example, the carriage may actuate a mechanism to feed a sheet of paper, thereby eliminating a need for a dedicated motor to actuate that mechanism. However, interaction between the carriage and mechanism may involve incomplete or faulty actuation, noise, damage, and/or other issues. Increasing carriage velocity prior to engagement may store kinetic energy in the carriage system to overcome a force load due to the carriage colliding with another mechanical part. However, storing kinetic energy may lead to wasted energy, and may generate noisy collisions that could potentially damage the carriage and/or apparatus.

Examples provided herein may greatly reduce an amount of kinetic energy in the carriage for interacting with a mechanism, while still achieving a successful, quiet, and reliable engagement sequence. Even with limited processing and/or bandwidth capabilities, examples may enhance and control velocity during an engagement sequence. Examples may avoid using excess energy associated with predetermined torque profiles, by accommodating variations in mechanical loads and achieving successful engagement upon first interaction, without a need to provide numerous attempts at ever increasing force levels. Engagements are reliable and controlled, while minimizing energy levels, resulting in a quieter engagement between a carriage and a mechanism.

In an example, feed forward control may be used to manage kinetic energy of the pen carriage for carriage engagement sequences, such as when engaging the carriage with a transmission shift arm or pen capping assembly. The feed forward control may help to reduce kinetic energy in the carriage system when engaging with a mechanism for lower-energy, more tightly controlled carriage velocity, enabling a quieter and more reliable engagement sequence. The feed forward control may be augmented with feedback control. For example, a motor voltage computed by a feedback servo control may be combined with a value from a feed forward table of predetermined motor voltages, to generate an overall voltage behavior applied to the motor driving the carriage. Thus, the predetermined motor voltages may anticipate any generated torque loads caused by force loadings from the engagement mechanism, while handling any incidental effects that may arise.

Figure 1:
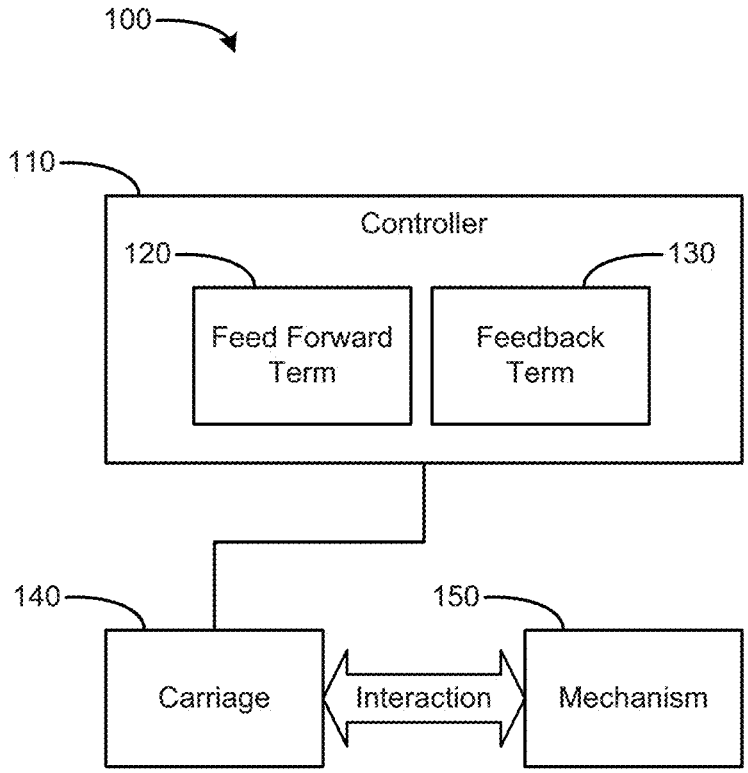
FIG. 1 is a block diagram of an apparatus including a controller, a carriage, and a mechanism according to an example.

FIG. 1 is a block diagram of an apparatus 100 including a controller 110, a carriage 140, and a mechanism 150 according to an example. The controller 110 includes a feed forward term 120 and a feedback term 130, to control interaction between the carriage 140 and the mechanism 150.

The controller 110 may be any computing device, such as at least one processor, an application-specific integrated circuit (ASIC), or others. In an example, controller 110 may include mathematical functionality, e.g., a proportional integral (PI) controller, a proportional derivative (PD) controller, and/or a proportional integral derivative (PID) controller.

The carriage 140 may be associated with back-and-forth movement, to mark a page using, e.g., inkjet pens/cartridges or other marking supplies. A carriage 140 may hold the pens and move them across the page in a highly controlled manner at a low torque to conserve energy during quiet printing operations. The carriage 140 may be driven by a motor, and the carriage 140 may be driven to interact with mechanism 150.

Mechanism 150 may include various types of mechanisms. In an example, apparatus 100 may be a printer, and mechanism 150 may be a priming mechanism to run a pump to maintain pen health, including a portion with which the carriage 140 is to engage. In an alternate example, mechanism 150 may be a pen-to-paper space (PPS) adjustment mechanism, with which the carriage 140 is to engage to set the pen-to-paper spacing for printing appropriate to the pens and paper being used. Other types of mechanisms 150 are contemplated, including an apparatus 100 having multiple mechanisms (e.g., shift arm and capping assembly mechanisms, as explained in further detail below).

Interaction between carriage 140 and mechanism 150 may involve forces based on friction, spring loads, mass, velocity, inertia, momentum, and other characteristics. In an example, apparatus 100 may include generally very low-mass mechanism(s) 150, such that interaction primarily involves overcoming forces other than inertial (e.g., mass-based) forces. Actuating such a mechanism 150 may involve overcoming a spring force, which may be much greater in magnitude than mass-based forces. In an alternate (e.g., more massive mechanism) example, controller 110 may compensate for inertial and other forces associated with moving and interacting with (relatively) large masses, in addition to any other forces such as spring forces. Feed forward term 120 of controller 110 may be used to provide compensation at the first point of contact to overcome inertial/friction loads (e.g., including an acceleration profile in the feed forward term 120). Similar approaches, of modifying the feed forward term 120 and/or the feedback term 130, may be used to address potential forces, including any collision forces, which may be associated with apparatus 100.

In an example, mechanism 150 may be a shift arm included in the apparatus 100. The carriage 140 may use the shift arm to engage a transmission (interacting with the shift arm of the transmission). In an example, a spring-loaded transmission shift arm may be positioned such that the carriage 140 may engage with and actuate the shift arm. Displacing the shift arm a corresponding amount may result in another action in apparatus 100, similar to shifting a car's manual transmission. For example, engaging the carriage 140 with a shift mechanism, and pushing on the shift mechanism a first amount, may cause apparatus 100 to pick a sheet of paper. Pushing on the mechanism a second amount may cause the apparatus 100 to actuate a print-head service station (or other mechanism). In an example, apparatus 100 may have a procedure to move the carriage 140 aside, away from the paper, to engage a mechanism 150 and squirt ink out and clear the print head nozzles. Afterward, the apparatus 100 may engage another mechanism 150 to drive rubber wipers that sweep across the bottom of the pens to clean off excess ink. In an example, the mechanism 150 to drive the wipers under the pens may be run off a motor that also drives a paper feed axis of the apparatus 100. Thus, a transmission is used to disengage the feed axis, and engage the service station axis, controlled by a transmission shift arm mechanism 150 that enables interaction by the carriage 140. Thus, in this example, not only is the carriage 140 to interact with the mechanism 150 with sufficient force for engagement/actuation to fully disengage the paper feed axis; the carriage 140 is also to be positioned very accurately and precisely to be in a specific placement when the wipers pass by the carriage 140. Thus, control of the carriage 140 involves accuracy and precision. The example shift arm mechanism 150 of apparatus 100 may enable apparatus 100 to avoid malfunctioning (e.g., if it were to feed paper at the same time as servicing the pens), if the carriage 140 is controlled accurately and precisely based on the feed forward term 120 and the feedback term 130.

The apparatus 100 also may include a mechanism 150 that is a capping assembly. The capping assembly may be used to seal the bottom of the pens, to prevent them from drying out. Capping the pens may involve movement of a cap sled over an inclined plane/ramp, pushed by the carriage 140 such that pen caps may be brought up to the pens of the carriage 140. An associated interaction force increases during travel up the ramp, and decreases after crossing over the top of the ramp. If the carriage 140 is not moved with enough energy, the carriage 140 may not get all the way to the top of the ramp to get a good seal on the pens. If the carriage 140 is moved with too much energy, it may pass over the center of the cap sled and hit a wall to generate a loud clunk.

Thus, it is important to manage the energy of the carriage 140, to enable the carriage 140 to interact with various mechanisms 150. Controller 110 may control the carriage 140 precisely, accurately, and efficiently, based on the feed forward term 120 and the feedback term 130.

The feed forward term 120 and the feedback term 130 enable the apparatus 100 to anticipate interactions between the carriage 140 and mechanism(s) 150, as well as to deal with incidental issues that may arise. In an example, several million copies of a printer model may be produced, and it may be that no two are perfectly alike (e.g., due to manufacturing variations). If the controller 110 were to rely on one set of predetermined techniques for interacting, those techniques may possibly not match any particular printer perfectly. Furthermore, over a printer's operational lifetime, the operational loads may change, environmental characteristics such as temperature may vary, usage may generate heat and wear, and many other disturbances may affect operation and reliability of apparatus 100. Thus, use of feedback term 130 and feed forward term 120 may provide enhanced system robustness, and may account for anticipated, unforeseen, and other forms of variability.

The feed forward term 120 and the feedback term 130 may produce a combined effect on control of the carriage 140. The feed forward term 120 may be associated with different values for different positions of the carriage 140, such that the feed forward term 120 may change as a function of carriage position. The feedback term 130 may be used to compensate for variations, to drive the carriage 140 at a desired/specified velocity, as well as handle any variations in the system in addition to those accounted for by the feed forward term 120.

Effect(s) of the feed forward term 120 and the feedback term 130 may be used to actuate the mechanism 150 (e.g., a shift arm or actuation of a cap sled). Prior to engagement/interaction, such as when the carriage 140 is positioned several centimeters away from mechanism 150, a value for the feed forward term 120 may be zero for those carriage positions. As the carriage 140 approaches the mechanism 150, including at the time and carriage position that the carriage 140 contacts the mechanism 150, it is desirable for the carriage 140 to apply a force that would be equal and opposite to any forces (e.g., canceling a torque) that the carriage 140 would encounter from interaction with the mechanism 150. For example, the carriage 140 may produce an equal and opposite force to an interaction force that a lever arm mechanism 150 would apply to the carriage 140. Such forces may be associated with an expected position of the carriage 140, such that techniques for controlling the carriage 140 may accommodate points of contact (e.g., interaction) along the travel range of the carriage 140.

Thus, the feed forward term 120 and feedback term 130 enable the controller 110 to use the carriage 140 in a controlled manner to reliably and quietly interact with (e.g., impart a force on) mechanism 150. The feed forward term 120 can enable the controller 110 to anticipate or predict the interaction between the carriage 140 and mechanism 150, to know ahead of time what a force profile of the interaction should look like for particular mechanism(s) 150. Combined effects of the feed forward term 120 and feedback term 130 can provide noise robustness and accommodate any variations in the system/apparatus 100. Thus, even if predetermined controller values are slightly mismatched for a particular printer among millions of printers, controller 110 may avoid faulty or noisy output responses. Even if feedback control would otherwise be associated with inherent response lag when the carriage 140 interacts with mechanism 150 to impart a force on the carriage 140, the controller 110 may avoid lagging behind, or having to use a repetitious and noisy re-try approach at increasing torque values. Thus, controller 110 may combine feed forward term 120 with feedback term 130, the combined approach thereby avoiding weaknesses that may be present in either form of control taken alone.

Apparatus 100 enables full functionality with fewer motors. Motorized functionality may be removed from other subsystems, by relying on the carriage 140 to provide the interaction to accomplish these functions. Such solutions may provide benefits in developing markets, minimizing the numbers of motors in a system and bringing down system cost and complexity. In an example, a service station motor may be omitted, and system 100 may use one motor to move the carriage 140 back and forth, and another motor to move the paper axis. A transmission mechanism 150 enables multifunctionality using a limited number of motors. A paper feed motor may be used to drive a service station, and a carriage motor may be used to cap the pens. Example control techniques may reduce the velocity of initially engaging interaction between the carriage 140 and the mechanism 150, anticipating the upcoming increased load in the system without needing to build up high velocity or kinetic energy. Incorporating the feedback term 130 and the feed forward term 120 enables engagement at a slower speed because controller 110 is not relying on the kinetic energy itself, stored in the carriage 140, to play a part in overcoming a load. Reliability is increased, because the controller 110 does not need to use an iterative re-try approach to position the carriage 140 accurately and precisely, which may avoid a need to transition the carriage 140 between dynamic and static friction states (or a need to allow the carriage 140 to reach zero velocity for an engagement re-try), increasing reliability.

The interaction may arise from the carriage 140 being used in a force mode. The controller 110 may enable the carriage 140 to be operated according to a specific force profile (e.g., corresponding to a particular mechanism 150, including being controlled according to a plurality of specific force profiles corresponding to a respective plurality of mechanisms). Because the controller 110 can predict ahead of time (e.g., using the feed forward term 120 and/or the feedback term 130) what the force profile should be for a given mechanism 150 corresponding to a given position of the carriage 140, such intelligence may be embedded into the controller 110.

The interaction may involve spring forces, and the forces may be applied in multiple directions. In an example, the controller 110 may use the carriage 140 to apply forces to a shift mechanism 150 along an x-axis and a z-axis. Such forces may be applied in a non-linear manner. For example, if location is expressed as L, a force may be expressed as $(A*L^2)+(B*L)+C$, where A, B, and C are constants that differ for x-axis and z-axis forces for different mechanisms 150. Such force profiles also may be caused to vary over time or between different mechanisms/printers (apparatus 100).

Figure 2:
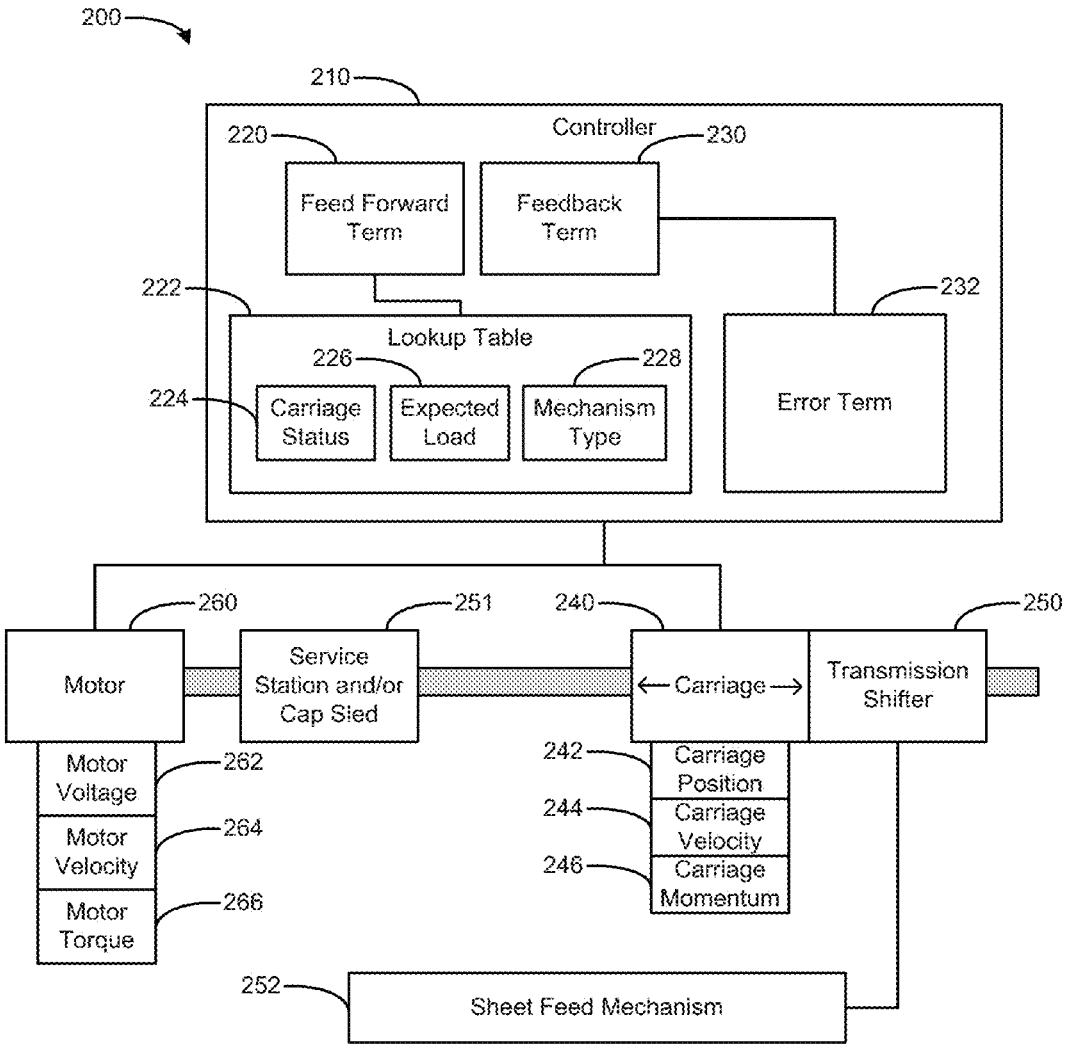
FIG. 2 is a block diagram of an apparatus including a controller, a carriage, a first mechanism, and a second mechanism according to an example.

FIG. 2 is a block diagram of an apparatus 200 including a controller 210, a carriage 240, a first mechanism (transmission shifter 250), and a second mechanism (service station and/or cap sled 251) according to an example. Apparatus 200 also includes a motor 260 and sheet feed mechanism 252. The controller 210 includes feed forward term 220 and feedback term 230. The feed forward term 220 is associated with a lookup table 222, including a carriage status 224, expected load 226, and mechanism type 228. The feedback term 230 is associated with error term 232. The carriage 240 is associated with carriage position 242, carriage velocity 244, and carriage momentum 246. The motor 260 is associated with a motor voltage 262, motor velocity 264, and motor torque 266. The transmission shifter 250 is associated with the sheet feed mechanism 252.

The carriage 240 is movable to the left and right as illustrated by arrows in FIG. 2, to selectively interact with the first and second mechanisms 250, 251. The carriage 240 is shown interacting with the transmission shifter mechanism 250, and spaced apart from (and not interacting with) the service station and/or cap sled mechanism 251. During a typical printing movement during which ink is marked on the page, the carriage 240 generally may not be engaged with a mechanism. But during a driving/force mode operation, the carriage 240 may be positioned near a mechanism (e.g., to an extreme right or left, beyond a print area) to engage and interact with that mechanism. As illustrated, the carriage 240 is interacting with the transmission shifter 250 to actuate the sheet feed mechanism 252 to feed a sheet of paper.

The controller 210 may use a feed forward term 220 that is based on lookup table 222. The lookup table 222 may include a correspondence between a carriage status 224 (e.g., a carriage position 242 or other feature of the carriage 242), and an expected load 226 for that carriage status 224. The expected load 226 also may be based on a mechanism type 228, such as a transmission shifter 250 corresponding to the given carriage position 242 (i.e., a carriage position at which the carriage 240 would encounter a mechanism). The controller 210 may monitor various characteristics of the carriage 240, including carriage position 242, carriage velocity 244, and carriage momentum 246. The carriage velocity 244 may be expressed in inches per second (IPS). Monitoring the characteristics of the carriage 240 enables the controller 210 to identify the carriage status 224 and its correspondence in the lookup table 222 for providing feed forward term 220, to thereby adjust operation of the carriage 240. In an example, the controller 210 may adjust the carriage 240 by adjusting motor 260, including by adjusting a motor voltage 262 (and/or current), motor velocity 264, and motor torque 266. The lookup table 222 may accommodate multiple load profiles, which may be different for different mechanisms to be engaged.

The lookup table 222 for the feed forward term 220 may not exactly match a given load (e.g., due to wear over time), so the controller 210 may apply the feedback term 230 for further enhanced control. For example, if the feed forward term 220 would otherwise cause the carriage control to lag slightly, the controller 210 may use the feedback term 230 to correct the lag (e.g., boost the motor voltage 262) to address any potential deviation that may affect the lookup table 222. Thus, the feedback term 230 may accumulate an error term 232, to compensate the feed forward term 220. The combined feed forward term 220 and the feedback term 230 thereby may enable control based on a closed-loop system.

The controller 210 may provide pulse-width modulation (PWM) functionality, e.g., to control the motor 260. In an example, the controller 210 may be a proportional integral (PI), proportional derivative (PD), and/or a proportional integral derivative (PID) controller 210 to calculate and generate the motor voltage 262 as a PWM signal. Thus, the error term 232 may drive the feedback term 230 and feedback behavior aspect of the controller 210. Other types of controllers and/or processors may be used as controller 210, and controller 210 is not limited to any specific type. In an example, the controller 210 may calculate the PWM signal based on the error term 232 and an integral (or derivative) of the error term 232, to follow a commanded signal (e.g., as directed by the feed forward term 220). In an example, if the output gets further behind the commanded signal, the controller 210 may determine the error term 232 and the derivative and/or integral of the error term 232, generated as number that is then converted by the controller 210 into a voltage. As an example, if the error is zero, then the feedback voltage would be zero.

The motor voltage 262 computed by the controller 210 may be further combined with other value(s) from the lookup table 222, including other predetermined motor voltages, to generate the motor voltage 262 applied to the motor 260 to maintain a controlled velocity when interacting with a mechanism. Such predetermined motor voltages may be engineered to generate loads based on motor torque 266 that will be equal to the known force loadings expected by engagement with the mechanisms. Motor voltage 262 used for moving the carriage 240 may change as the carriage 240 moves through its ranges of carriage positions 242. Thus, the controller 210 may use a relatively lower motor voltage 262 throughout some parts of the carriage movement (e.g., when moving the carriage 240 without driving a mechanism).

Computations by the controller 210 may involve digital and analog aspects with corresponding associated systems. A sensor may provide measurements to the controller 210 regarding the carriage position 242, and that may be fed into a digital controller 210 that performs calculations to generate a PWM number that represents a duty cycle. The duty cycle may be sent by the controller 210 to analog electronics that generate an analog motor voltage 262 actually applied to the motor 260. Thus, controller 210 may represent multiple different controllers.

In an example, a 30 volt (V) voltage source may be pulse-width modulated to provide a range of corresponding effective motor voltages 262. Thus, the 30 V source may be modified by PWM to change a duty cycle of how long the controller 210 is to apply the full 30 V. The controller 210 may use PWM to change a duty cycle of the motor voltage 262. Thus, applying a 30 V source at 50% PWM duty cycle can generate the equivalent of roughly 15 V, if applied to the motor 260. Controller 210 effectively may provide a range of voltages (which may include a motor actuating integrated circuit, or analog ASIC) to convert the digital PWM signal to an analog motor voltage 262.

In an example, PWM values may be expressed as an 8-bit value ranging from 0-255. The PWM value may be expressed in terms of a duty cycle, and the duty cycle may be converted into an equivalent applied motor voltage. For PWM=0, a corresponding duty cycle may be determined as 0/255=0%, and the equivalent applied motor voltage may be determined as 0%*30 V=0 V. In this example, a supply voltage is 30 V maximum for the motor, although other voltages and motors may be used. For PWM=128, corresponding duty cycle is 128/255=50%, which may be use do determine the equivalent applied motor voltage as 50%*30 V=15 V. For PWM=255, duty cycle is 255/255=100%, and equivalent applied motor voltage is 100%*30 V=30 V. Thus, the PWM value may be used to drive the motor at various equivalent voltages, resulting in varying motor velocities and/or torques. The various different equivalent applied motor voltages may be applied by a motor controller by selectively pulsing a 30 V source on and off.

Figure 3:
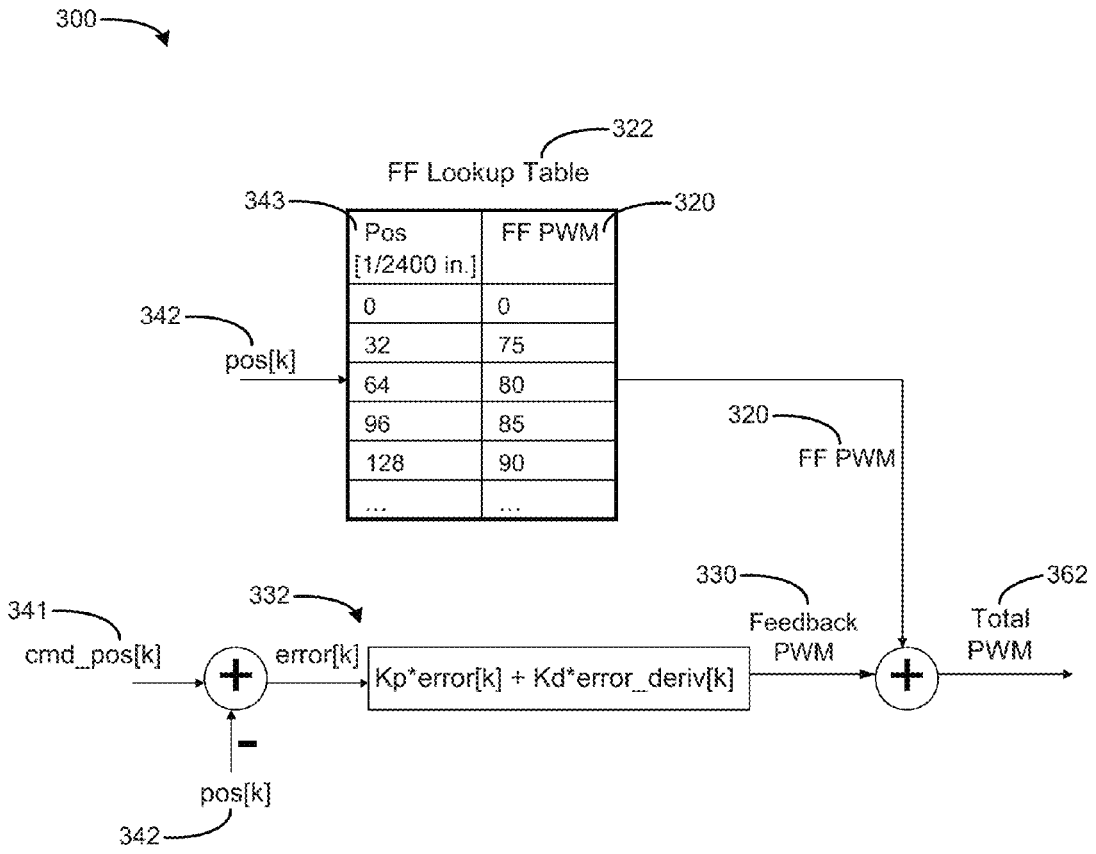
FIG. 3 is a block diagram of a system including a feed forward term and a feedback term according to an example.

FIG. 3 is a block diagram of a system 300 including a feed forward term 320 and a feedback term 330 according to an example. System 300 also includes a lookup table 322, and an error term 332. The lookup table 322 may include lookup positions 343 and feed forward terms 320.

Variables in FIG. 3 are expressed in terms of position information. In this example, the command position 341 (cmd_pos[k]) is moved as a function of time. Variables are to follow a velocity profile, by moving the command position in known increments. In an example, at time zero, command position 341 is zero, at time 1, command position 341 is 1, and at time 2, command position 341 is 2. In other words, at every time step, the command position 341 is moved 1, such that the velocity would be in terms of one step per interrupt. The value for the interrupt time may be chosen arbitrarily.

System 300 enables carriage position 342 (expressed as pos[k]) to be received at an upper branch to be converted by the lookup table 322 into a corresponding feed forward term 320 (expressed as FF PWM). The example lookup table 322 shows lookup positions 343 expressed as values of $\frac{1}{2400}$ of an inch (in.), along with their corresponding feed forward terms 320. Position 343, which would be 64 at time k, corresponds to a PWM value of 80. Command position 341 (a target profile for that position, expressed as cmd_pos[k]) is received at a lower branch to be combined with the negative of carriage position 342, to generate error term 332. Error term 332 may be expressed as error[k], which may include components such as proportional gain Kp, and derivative gain Kd. The error box, designated by error term 332, is expressed for a KD controller, having both a derivative term and a proportional term, for damping effects. In the illustrated example, the proportional gain is multiplied by the error term, and added to the product of the derivative gain and error derivative (where error_deriv=error[k]−error[k−1]). The result is feedback term 330, expressed as feedback PWM. The feed forward term 320 from the upper branch is combined with the feedback term 330 of the lower branch to produce, e.g., a motor voltage, expressed as total PWM 362.

In servo motors generally, there may be an inherent lag error when the servo first starts. Because a voltage may be proportional to the error, the difference may manifest as the signal difference between the commanded velocity (e.g., command position 341) and the actual velocity (e.g., carriage position 342). This inherent lag issue may build up enough error to generate a voltage that is large enough to move the servo, e.g., move the carriage. This error term accumulation process, to compensate for the lag error, may be enhanced by preloading the system with a feed-forward value, e.g., feed forward term 320. If a servo motor would normally use a PWM voltage value of 100 to overcome inertia or other effects and begin rotating, system 300 may preload the total PWM value with the feed forward value to get the motor started sooner, without having to wait until the error term compensation accumulates large enough to generate that value of 100. Thus, the feed forward term 320 enables the system to maintain a constant low velocity/voltage when interacting with another mechanical element, without a need to build up a high motor voltage or high carriage kinetic energy. This results in smoother, quieter, and more accurate and predictable operation. The feed forward term 320 may represent a force that would be applied to the carriage by a mechanism during interaction. Thus, the multiple different forces and corresponding feed forward terms 320 may represent a force profile characteristic stored in the lookup table 322, which may be customized for various system (printer) characteristics.

Figure 4:
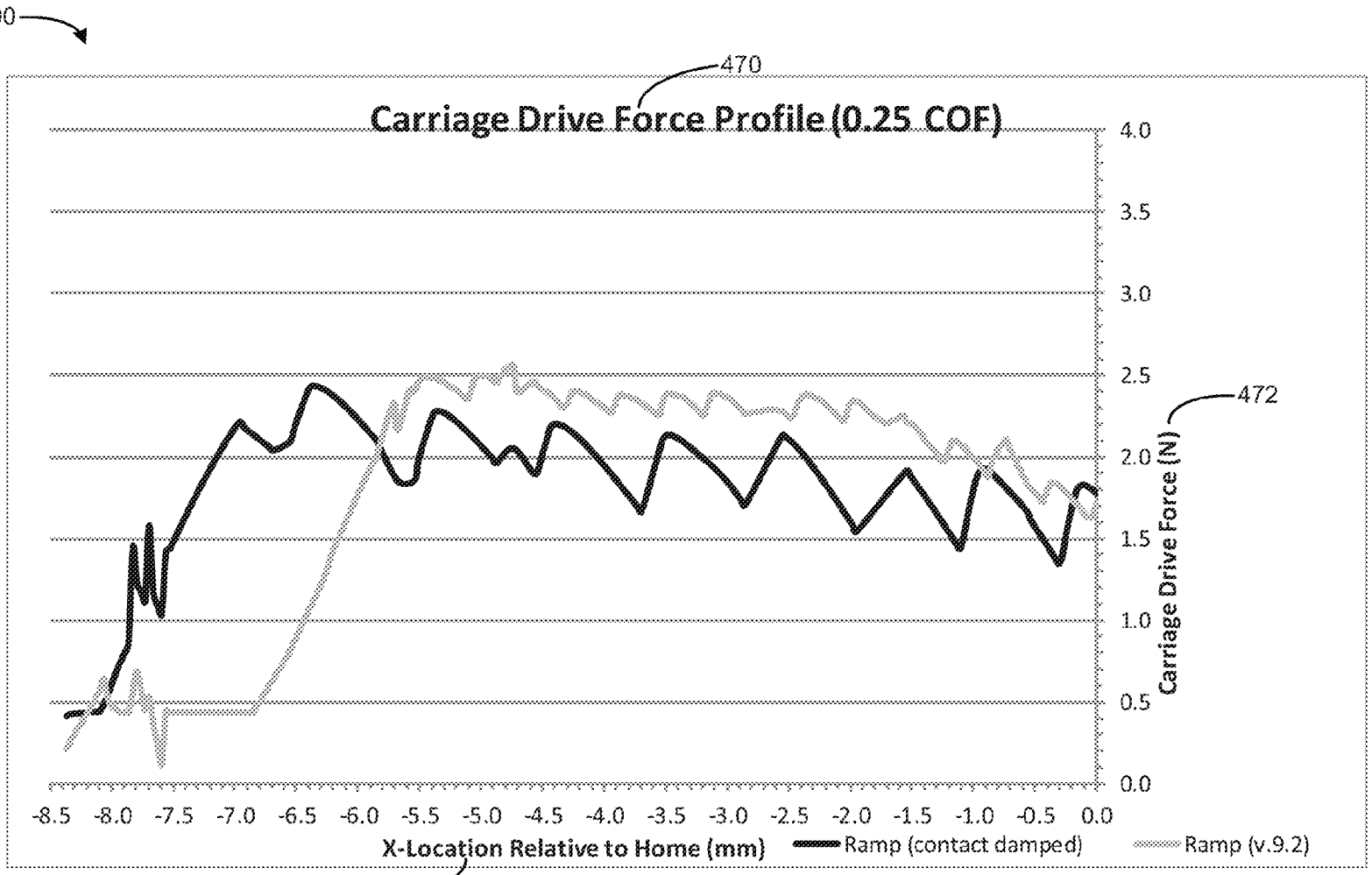
FIG. 4 is a chart of carriage drive force as a function of position according to an example.

FIG. 4 is a chart 400 of carriage drive force 472 as a function of position 474 according to an example. The data is to model/predict forces to be encountered by a carriage within a subset of approximately 8.5 millimeters of carriage movement, showing how carriage forces may change as a function of carriage position when engaging a ramp over that engagement distance. The two plots in FIG. 4 represent two different force profiles associated with mechanisms having a 0.25 coefficient of friction, labeled Ramp (contact damped), and Ramp (v.9.2). These two different force profiles may be designed into a controller. The two force profiles illustrate an offset, showing a difference in a contact point with the carriage, as represented by the step portion of each plot on the left side of FIG. 4. The offset represents moving the shift mechanism over, approximately 1.5 millimeters.

A controller may use a feed forward table to emulate the force profiles shown in the chart 400. Thus, the controller may use the feed forward table to compensate for, and overcome, the combined loads of the forces arising from engagement with and/or actuation of the mechanism, as well as forces to move the carriage itself.

Figure 5:
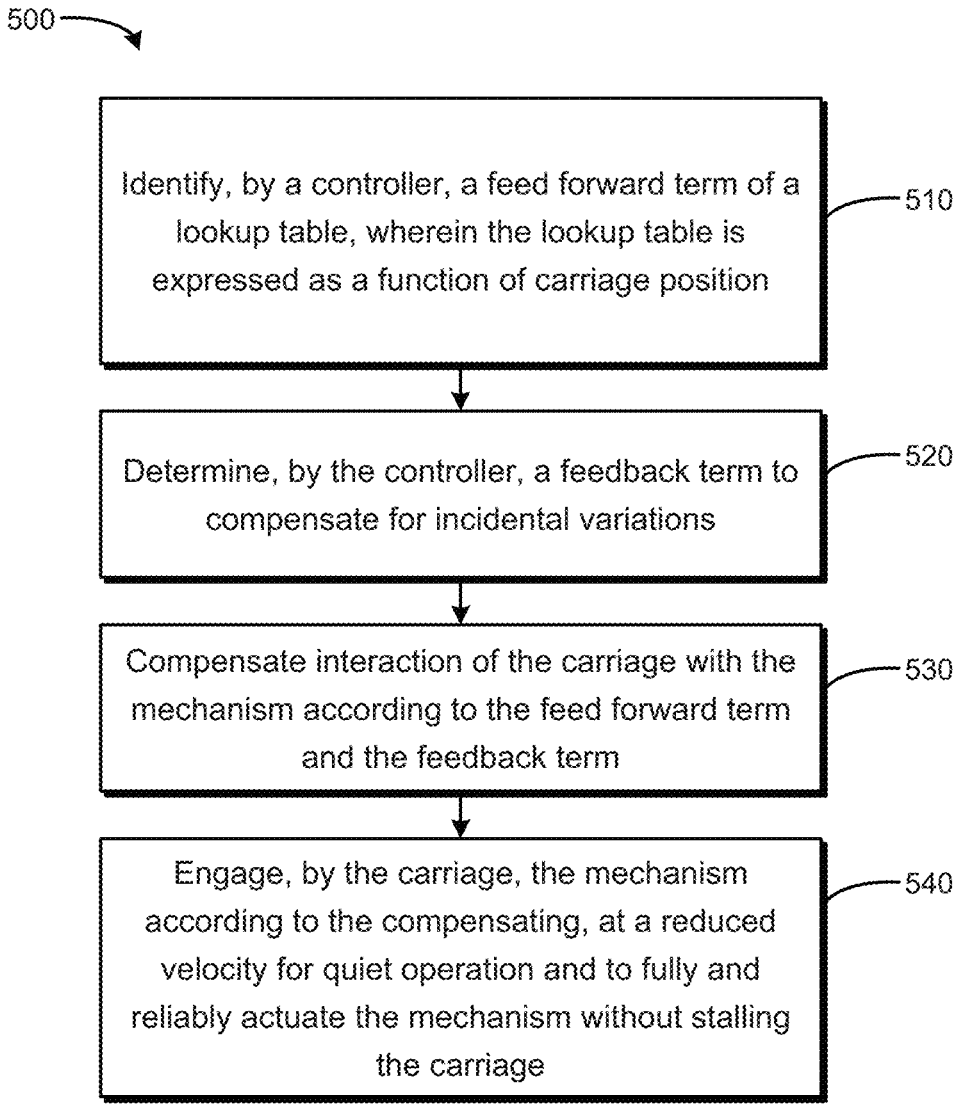
FIG. 5 is a flow chart based on compensating interaction of a carriage with a mechanism according to an example.
Figure 6:
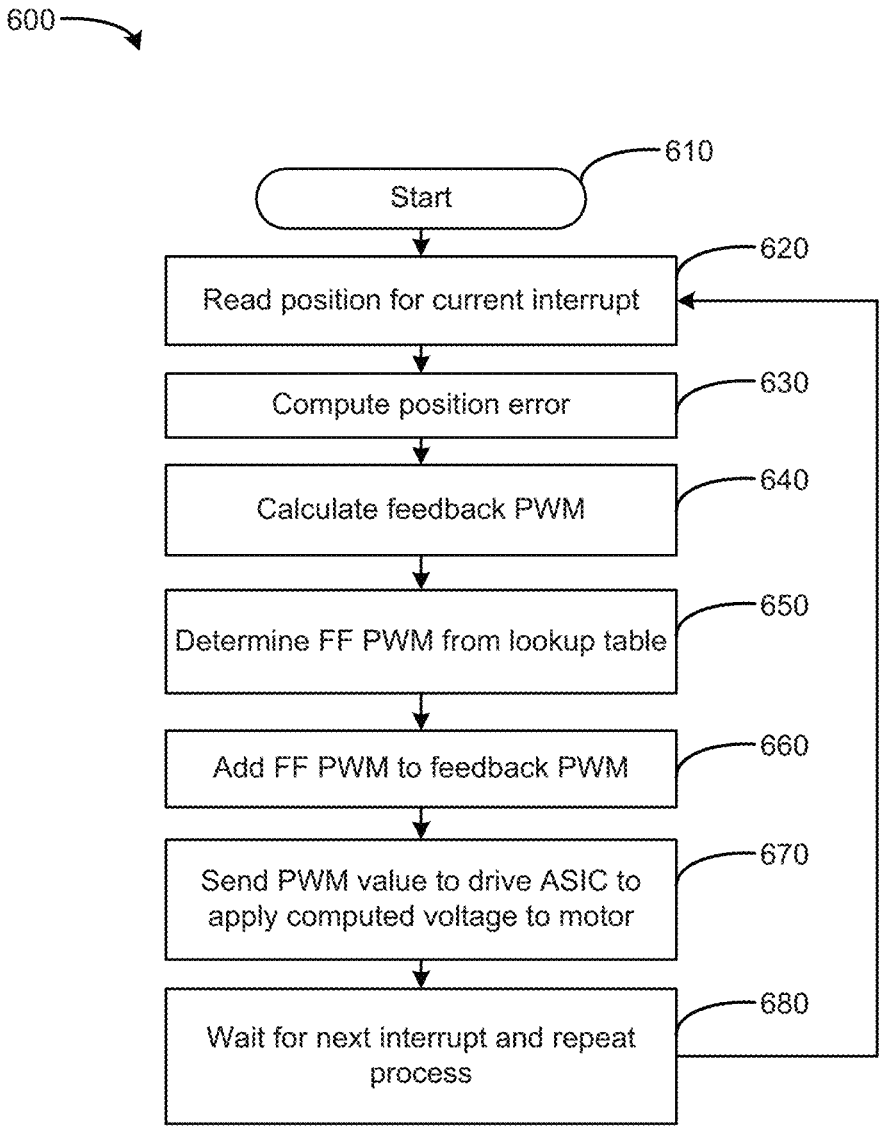
FIG. 6 is a flow chart based on driving a motor according to feed forward and feedback terms according to an example.

Referring to FIGS. 5 and 6, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 5 is a flow chart 500 based on compensating interaction of a carriage with a mechanism according to an example. In block 510, a controller is to identify a feed forward term of a lookup table, wherein the lookup table is expressed as a function of carriage position. In an example, the lookup table may include at least one force profile for compensating interaction between the carriage and a mechanism. In block 520, the controller is to determine a feedback term to compensate for incidental variations. For example, the controller may identify an error term, which may have accumulated through a feedback loop, to augment the feedback term and provide additional voltage. In block 530, interaction of the carriage with the mechanism is compensated according to the feed forward term and the feedback term. For example, a controller may combine the feedback and feed forward term to produce a resulting voltage, applied to the motor to anticipate the interaction and compensate for any variations. In block 540, the carriage is to engage the mechanism according to the compensating, at a reduced velocity for quiet operation and to fully and reliably actuate the mechanism without stalling the carriage. For example, the engagement may correspond to a physical momentum and kinetic energy of the carriage that would, by itself, be insufficient to fully and reliably actuate the mechanism. However, by anticipating a load profile of the mechanism, the controller may increase voltage to the motor for engagement according to the feed forward and feedback terms.

FIG. 6 is a flow chart 600 based on driving a motor according to feed forward and feedback terms according to an example. The flow chart 600 begins at block 610. In block 620, a position of a carriage is read to determine the current interrupt. For example, a carriage sensor may determine a position of the carriage, the sensor being monitored by the controller. In block 630, a position error is computed. For example, the controller can compare the sensed carriage position to a command carriage position, to determine a difference in position corresponding to a voltage. In block 640, a feedback PWM is calculated. For example, the controller may identify the magnitude of the difference in position and correlate that difference to a corresponding voltage, converted to a PWM value. In block 650, feed forward PWM is determined from a lookup table. For example, the controller may identify the current position, and identify the corresponding value of the lookup table for that current position. In block 660, the feed forward PWM is added to the feedback PWM. In alternate examples, the feed forward and feedback terms may be combined in other ways, such as multiplication, subtraction, proportional combination, or other combinations. In block 670, the PWM value is sent to drive an ASIC to apply a computed voltage to a motor. Other techniques may be used to convert the PWM value to an applied motor voltage, e.g., conversion may be built-in to the motor. In block 680, control is to wait for the next interrupt, and repeat the process by returning to block 620. For example, the controller may generate interrupts more frequently for a higher granularity of control.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., a computing device, printer, or other apparatus) can include and/or receive a tangible non-transitory computer-readable medium storing a set of computer-readable instructions (e.g., software). As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. An apparatus comprising:

a carriage;

a mechanism to be engaged by and actuated by the carriage; and a controller to control operation of the carriage according to a feed forward term and a feedback term, to compensate interaction of the carriage with the mechanism;

wherein compensating the interaction enables the carriage to engage the mechanism at a reduced velocity for quiet operation, and fully and reliably actuate the mechanism without stalling the carriage, and wherein the controller is to select the feed forward term from a lookup table expressed as a function of carriage position, wherein the feed forward term corresponds to a load associated with a type of mechanism expected to be encountered based on a status of the carriage.

2. The apparatus of claim 1, wherein the controller is to monitor the status of the carriage, including a carriage velocity and carriage position.

3. The apparatus of claim 1, further comprising a first feed forward term corresponding to a first mechanism, and a second feed forward term corresponding to a second mechanism, wherein the first feed forward term differs from the second feed forward term.

4. The apparatus of claim 1, wherein the controller is to generate the feedback term to compensate for incidental variations.

5. The apparatus of claim 1, wherein the controller is to control the carriage at a velocity to provide sufficient force to overcome an engagement load associated with engagement between the carriage and the mechanism.

6. The apparatus of claim 1, further comprising a motor to drive the carriage, wherein the controller is to control a velocity and torque of the motor to compensate the interaction.

7. The apparatus of claim 6, wherein the reduced velocity of engagement corresponds to a momentum and kinetic energy of the carriage insufficient to fully and reliably actuate the mechanism, wherein the controller is to anticipate by increasing voltage to the motor for engagement.

8. The apparatus of claim 1, wherein the mechanism is a transmission shifter of a printer actuatable to feed a sheet of paper to the printer.

9. The apparatus of claim 1, wherein the mechanism is a cap sled of a printer actuatable to engage a capping assembly to cap ink supplies of the carriage.

10. A method of controlling operation of a carriage, comprising:

identifying, by a controller, a feed forward term of a lookup table, wherein the lookup table is expressed as a function of carriage position;

determining, by the controller, a feedback term to compensate for incidental variations;

compensating interaction of the carriage with a mechanism according to the feed forward term and the feedback term; and engaging, by the carriage, the mechanism according to the compensating, at a reduced velocity for quiet operation and to fully and reliably actuate the mechanism without stalling the carriage, wherein the controller is to select the feed forward term from a lookup table expressed as a function of carriage position, wherein the feed forward term corresponds to a load associated with a type of mechanism expected to be encountered based on a status of the carriage.

11. The method of claim 10, further comprising:

determining an error term corresponding to a status of the carriage; and determining the feedback term based on the error term.

* * * * *